US010622714B2

(12) United States Patent
Eom

(10) Patent No.: US 10,622,714 B2
(45) Date of Patent: Apr. 14, 2020

(54) LINEAR SLOT ARRAY ANTENNA FOR BROADLY SCANNING FREQUENCY

(71) Applicant: ELECTRONICS AND TELECOMMUNICATIONS RESEARCH INSTITUTE, Daejeon (KR)

(72) Inventor: Soon Young Eom, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 115 days.

(21) Appl. No.: 16/025,804

(22) Filed: Jul. 2, 2018

(65) Prior Publication Data

US 2019/0305421 A1 Oct. 3, 2019

(30) Foreign Application Priority Data

Apr. 2, 2018 (KR) ..... 10-2018-0038112

(51) Int. Cl.

| | |
|---|---|
| ***H01Q 21/00*** | (2006.01) |
| ***H01Q 3/38*** | (2006.01) |
| ***H01Q 21/26*** | (2006.01) |
| ***H01P 3/08*** | (2006.01) |

(Continued)

(52) U.S. Cl.

CPC ..... *H01Q 3/38* (2013.01); *H01P 1/184* (2013.01); *H01P 3/08* (2013.01); *H01P 5/19* (2013.01); *H01Q 21/005* (2013.01); *H01Q 21/0025* (2013.01); *H01Q 21/26* (2013.01)

(58) Field of Classification Search

CPC ..... H01P 1/184; H01P 5/107; H01Q 21/00; H01Q 21/0025; H01Q 21/0037; H01Q 21/005; H01Q 21/26; H01Q 3/38; H01Q 1/38; H01Q 1/46

See application file for complete search history.

(56) References Cited

U.S. PATENT DOCUMENTS 2,836,822 A * 5/1958 Ehrlich ..... H01Q 15/04 343/754
3,039,097 A * 6/1962 Strumwasser ..... H01Q 19/175 343/771

(Continued)

OTHER PUBLICATIONS

S. Wolf et al., "A 32-element frequency-steered array antenna for reflectometry in W-band", 2013, pp. 1-7.

(Continued)

*Primary Examiner* — Tho G Phan

(57) ABSTRACT

Disclosed is an antenna device for performing frequency scanning, the antenna device including a T-junction configured to distribute a first feeding signal, a first radiating element configured to radiate a radio wave based on a second feeding signal, and a coupled transmission line configured to transmit, to a subsequent element, a third feeding signal remaining after subtracting the second feeding signal from the first feeding signal, wherein the coupled transmission line is coupled such that a length thereof is an integer multiple of a wavelength at a center frequency, and the T-junction, the first radiating element, and the coupled transmission line are connected in series to form a series feeding circuit network.

20 Claims, 29 Drawing Sheets

(51) Int. Cl.
*H01P 5/19* (2006.01)
*H01P 1/18* (2006.01)

(56) References Cited

U.S. PATENT DOCUMENTS

| | | | | | |
|---|---|---|---|---|---|
| 3,213,454 | A | * | 10/1965 | Ringenbach | H01Q 3/22 343/754 |
| 3,286,260 | A | * | 11/1966 | La Var Howard | H01Q 3/38 342/374 |
| 3,419,870 | A | | 12/1968 | Wong | |
| 3,434,139 | A | | 3/1969 | Alego | |
| 4,203,116 | A | * | 5/1980 | Lewin | H01Q 13/206 343/700 MS |
| 8,830,133 | B2 | * | 9/2014 | Weily | H01Q 1/38 343/767 |
| 9,287,614 | B2 | * | 3/2016 | Vahidpour | H01Q 1/36 |
| 10,020,594 | B2 | * | 7/2018 | Kim | H01Q 21/08 |
| 2013/0321198 | A1 | | 12/2013 | Park et al. | |
| 2016/0131741 | A1 | | 5/2016 | Park | |

OTHER PUBLICATIONS

Shaya Karimkashi et al., "A Dually Polarized Frequency Scanning Microstrip Array Antenna for Weather Radar Applications", 2013 7th European Conference on Antennas and Propagation (EuCAP), 2013, pp. 1795-1798, IEEE.

Zhiwei Sun et al., "A Wideband Frequency Scanning Microstrip Antenna Array with Low Profile", 2013 International Conference on Mechatronic Sciences, Electric Engineering and Computer (MEC), Dec. 20-22, 2013, pp. 3081-3084, IEEE, Shenyang, China.

* cited by examiner

LINEAR SLOT ARRAY ANTENNA FOR BROADLY SCANNING FREQUENCY

CROSS-REFERENCE TO RELATED APPLICATION(S)

This application claims the priority benefit of Korean Patent Application No. 10-2018-0038112 filed on Apr. 2, 2018, in the Korean Intellectual Property Office, the disclosure of which is incorporated herein by reference for all purposes.

BACKGROUND

1. Field

One or more example embodiments relate to a linear slot array antenna for broadly scanning a frequency.

2. Description of Related Art

An existing array antenna for wireless communications and radar forms high-speed electrical beams through an external control using an analog or digital phase shifter in a active channel block (ACB) unit. Since the phase shifter is expensive and an additional phase control circuit is required, a price of an antenna system increases. Further, small sub-arrays (phase-controllable array unit) are needed to form broad electrical beams, and thus the total number of sub-arrays used for the system increases, the number of phase shifters increases, and the total price of the antenna system increases.

A frequency-scanning electrical beam forming array antenna that overcomes the increase in the cost of the antenna system has been suggested. The principle of frequency-scanning electrical beam forming is that electrical beams of different directions are formed by different frequencies applied to input terminals of sub-array antennas that are connected in series, and the overall electrical beam forming range is determined based on a range of an operating frequency band applied to the input terminals of the antennas. Thus, a broad frequency band range is needed for frequency-scanning broad electrical beam forming.

SUMMARY

According to an aspect, there is provided an antenna device including a T-junction configured to distribute a first feeding signal, a first radiating element configured to radiate a radio wave based on a second feeding signal, and a coupled transmission line configured to transmit, to a subsequent element, a third feeding signal remaining after subtracting the second feeding signal from the first feeding signal, wherein the coupled transmission line may be coupled such that a length thereof is an integer multiple of a wavelength at a center frequency, and the T-junction, the first radiating element, and the coupled transmission line may be connected in series to form a series feeding circuit network.

A number of T-junctions may be N, a number of first radiating elements may be N+1, and a number of coupled transmission lines may be N.

The antenna device may include a plurality of frequency-scanning array antennas, and at least one of the plurality of frequency-scanning array antennas may include the T-junction, the first radiating element, and the coupled transmission line.

The antenna device may include a waveguide input terminal configured to input the first feeding signal.

The coupled transmission line may be implemented using low temperature co-fired ceramic (LTCC) technology or monolithic microwave integrated circuit (MMIC) technology.

The coupled transmission line may include a phase slope control circuit (PSCC) including a transmission line and stub lines.

The stub lines may include a first stub line having a first characteristic impedance and a first electrical length, and a second stub line having a second characteristic impedance and a second electrical length, wherein the transmission line may be disposed between the first stub line and the second stub line.

The first stub line and the second stub line may include an open stub and a shorted stub that are connected in parallel.

The first characteristic impedance and the second characteristic impedance may be equal.

The first electrical length and the second electrical length may be 45 degrees.

The T-junction, the first radiating element, and the coupled transmission line may be implemented on a dielectric film layer.

The antenna device may include an upper metallic body disposed on the dielectric film layer, the upper metallic body including grooves corresponding to the T-junction, the first radiating element, and the coupled transmission line, and a lower metallic body disposed beneath the dielectric film layer, the lower metallic body including grooves corresponding to the T-junction, the first radiating element, and the coupled transmission line.

The upper metallic body may include a first groove configured such that a waveguide input terminal of the dielectric film layer receives the first feeding signal, a slot configured such that the first radiating element radiates the radio wave, and a second groove configured such that the coupled transmission line transmits the third feeding signal in a transverse electromagnetic (TEM) mode.

The upper metallic body may further include a third groove configured such that the T-junction equally distributes the first feeding signal, wherein, when the third groove is a groove relatively close to the first groove, a depth thereof may be relatively shallow.

The upper metallic body may further include a first dielectric disposed in the second groove to increase a permittivity thereof.

The upper metallic body may include a wedge structure to improve a directivity with respect to the radio wave.

The lower metallic body may include a waveguide aperture configured to input the first feeding signal into a waveguide input terminal of the dielectric film layer, a fourth groove configured such that the first radiating element radiates the radio wave, and a fifth groove configured such that the coupled transmission line transmits the third feeding signal in a TEM mode.

The lower metallic body may further include a sixth groove configured such that the T-junction equally distributes the first feeding signal, wherein, when the sixth groove is a groove relatively close to the waveguide aperture, a depth thereof may be relatively shallow.

The waveguide aperture may be disposed to rotate 90 degrees with respect to the waveguide input terminal.

The lower metallic body may further include a second dielectric disposed in the fifth groove to increase a permittivity thereof.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
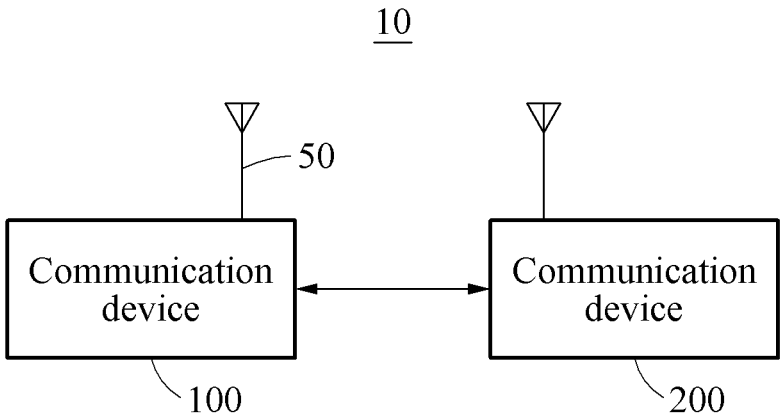
FIG. 1 is a block diagram illustrating a communication system according to an example embodiment.

Hereinafter, reference will now be made in detail to examples with reference to the accompanying drawings, wherein like reference numerals refer to like elements throughout. Various alterations and modifications may be made to the examples. Here, the examples are not construed as limited to the disclosure and should be understood to include all changes, equivalents, and replacements within the idea and the technical scope of the disclosure.

The terminology used herein is for the purpose of describing particular examples only and is not to be limiting of the examples. As used herein, the singular forms "a", "an", and "the" are intended to include the plural forms as well, unless the context clearly indicates otherwise. It will be further understood that the terms "include/comprise" and/or "have" when used in this specification, specify the presence of stated features, integers, steps, operations, elements, components, and/or combinations thereof, but do not preclude the presence or addition of one or more other features, numbers, steps, operations, elements, components, and/or groups thereof.

Terms, such as first, second, and the like, may be used herein to describe components. Each of these terminologies is not used to define an essence, order or sequence of a corresponding component but used merely to distinguish the corresponding component from other component(s). For example, a first component may be referred to as a second component, and similarly the second component may also be referred to as the first component.

Unless otherwise defined, all terms including technical and scientific terms used herein have the same meaning as commonly understood by one of ordinary skill in the art to which examples belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

When describing the examples with reference to the accompanying drawings, like reference numerals refer to like constituent elements and a repeated description related thereto will be omitted. When it is determined detailed description related to a related known function or configuration they may make the purpose of the examples unnecessarily ambiguous in describing the examples, the detailed description will be omitted here.

Figure 2A:
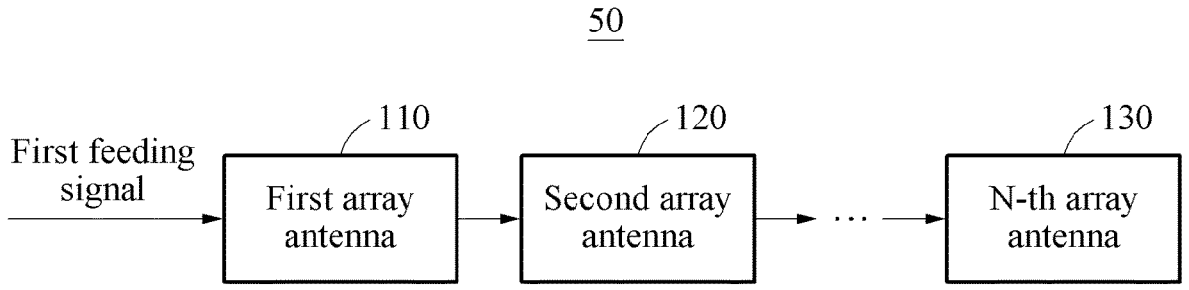
FIG. 2A is a block diagram illustrating an antenna device according to an example embodiment.
Figure 2B:
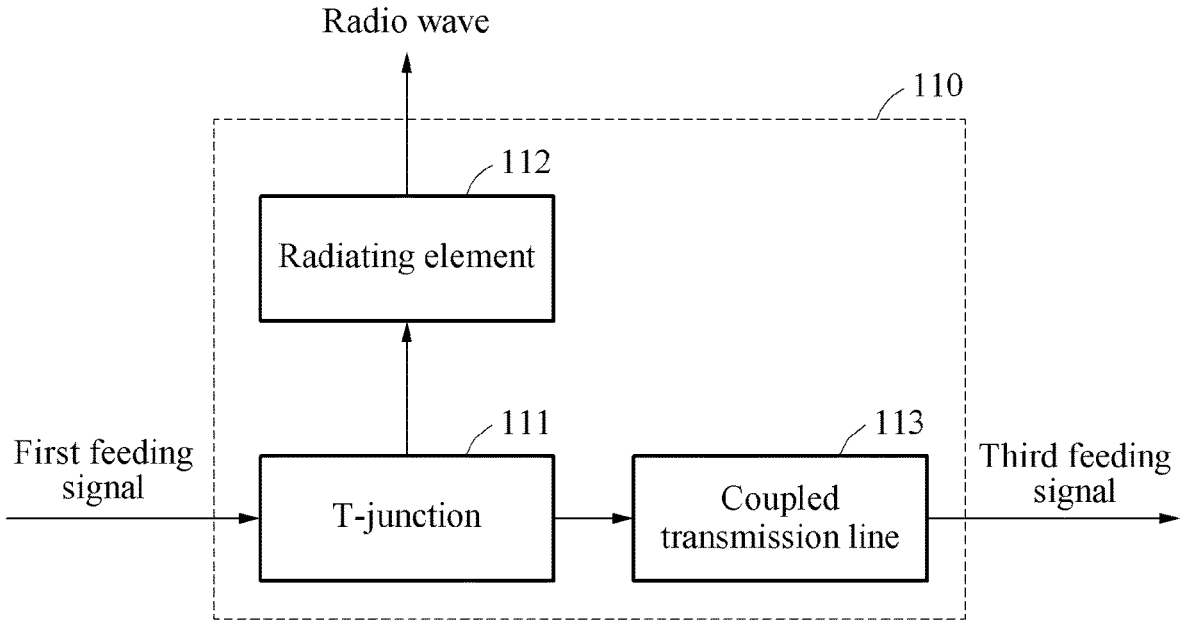
FIG. 2B is a block diagram illustrating an example of a first array antenna of FIG. 2A.
Figure 2C:
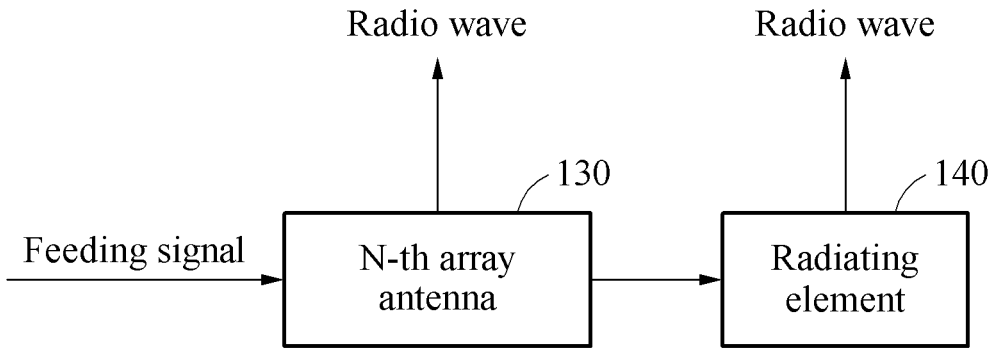
FIG. 2C is a diagram illustrating a connection relationship of a last array antenna included in an antenna device.
Figure 2D:
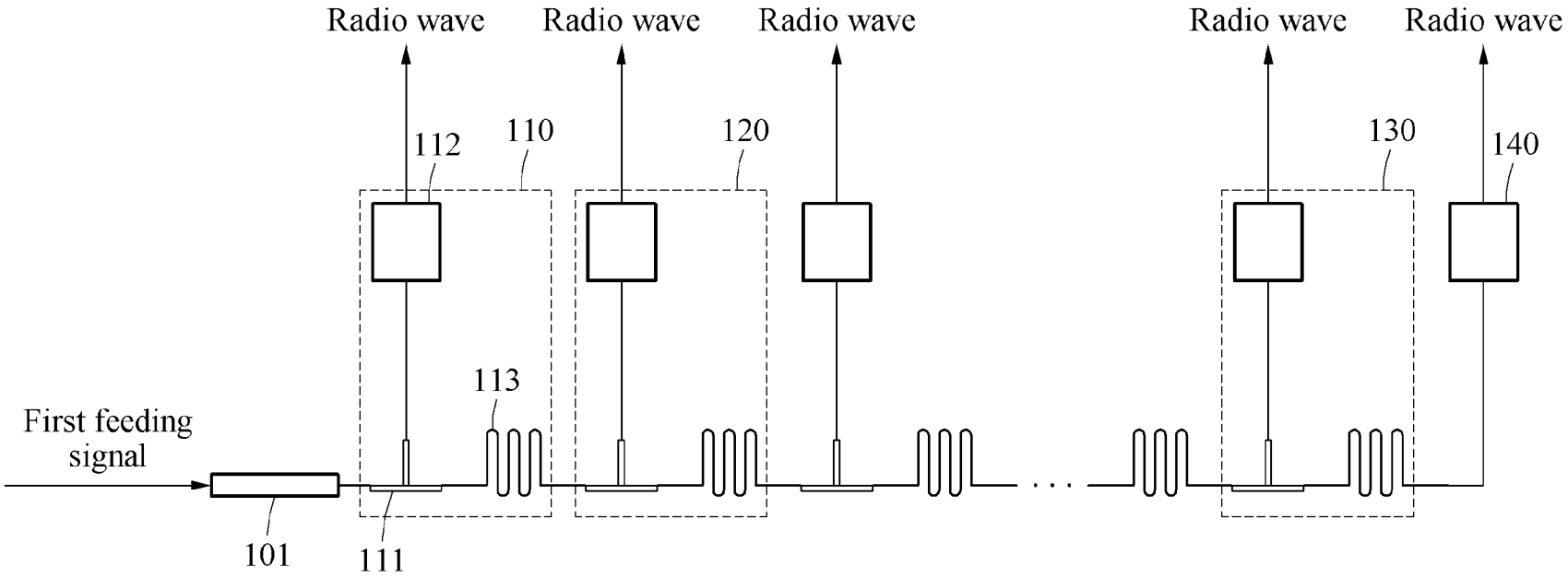
FIG. 2D is a diagram illustrating a structure of an antenna device according to an example embodiment.
Figure 3:
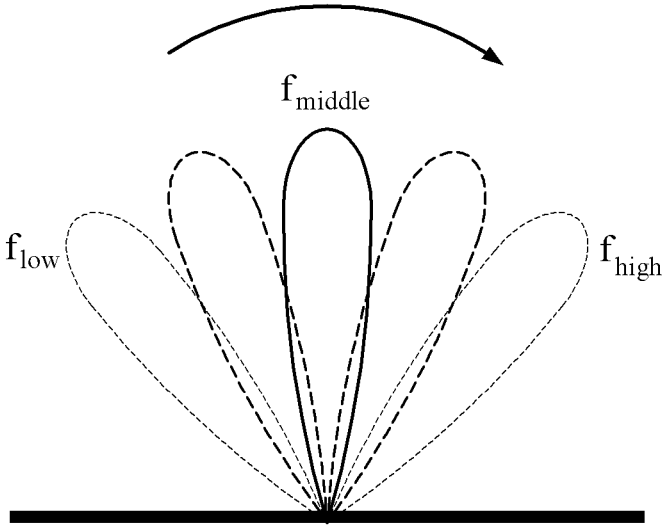
FIG. 3 illustrates frequency scanning.

FIG. 1 is a block diagram illustrating a communication system according to an example embodiment, FIG. 2A is a block diagram illustrating an antenna device according to an example embodiment, FIG. 2B is a block diagram illustrating an example of a first array antenna of FIG. 2A, FIG. 2C is a diagram illustrating a connection relationship of a last array antenna included in the antenna device, FIG. 2D is a diagram illustrating a structure of the antenna device according to an example embodiment, and FIG. 3 illustrates frequency scanning.

Referring to FIGS. 1 through 3, a communication system 10 may include communication devices 100 and 200. The communication device 100 and the communication device 200 may communicate with each other using antenna devices. For example, the communication device 100 may include an antenna device 50. The antenna device 50 may refer to a linear slot array antenna for broadly scanning a frequency.

The antenna device 50 may include a plurality of array antennas. The plurality of array antennas may include a first array antenna 110, a second array antenna 120, . . . , an N-th array antenna 130. The first array antenna 110, the second array antenna 120, . . . , the N-th array antenna 130 may be connected in series. That is, the antenna device 50 may include a structure of a series feeding circuit network. The first array antenna 110, the second array antenna 120, . . . , the N-th array antenna 130 may radiate radio waves based on feeding signals.

For example, the first array antenna 110 may receive a first feeding signal and radiate a radio wave. The first feeding signal may refer to a feeding signal including a second feeding signal and a third feeding signal. That is, the first array antenna 110 may radiate the radio wave based on the second feeding signal and transmit the third feeding signal to the second array antenna 120.

The antenna device 50 may perform frequency scanning using the plurality of array antennas. That is, the antenna device 50 may perform electrical beam scanning in a predetermined frequency bandwidth.

Hereinafter, a structure of the first array antenna 110 will be described with reference to FIG. 2B. The structure of the first array antenna 110 may be applicable to structures of the second array antenna 120, . . . , the N-th array antenna 130.

The first array antenna 110 may include a T-junction 111, a radiating element 112, and a coupled transmission line 113.

The T-junction 111 may distribute the first feeding signal to the radiating element 112 and the coupled transmission line 113. The T-junction 111 may be designed such that feeding signals may be equally distributed to radiating elements of the plurality of array antennas. For example, in a case in which a number of the plurality of array antennas is "N", the T-junction 111 may be designed such that the second feeding signal may be 1/N of the first feeding signal. That is, the T-junction 111 may be designed such that the third feeding signal may be (N−1)/N of the first feeding signal. Thus, the radiating elements of the plurality of array antennas may receive feeding signals of the same size and radiate radio waves.

The radiating element 112 may be implemented as a broadband antenna element having a horizontal polarization characteristic. The radiating element 112 may radiate a radio wave based on the second feeding signal received from the T-junction 111. The radiating element 112 may perform electrical beam scanning by radiating the radio wave based on a frequency of the second feeding signal. An operation of the radiating element 112 radiating the radio wave in a vertical (elevation) direction based on the frequency of the second feeding signal is shown in FIG. 3.

In a case in which the frequency of the second feeding signal is a middle frequency $f_{middle}$, the radiating element 112 may radiate the radio wave in a direction vertical to the antenna device 50. The middle frequency $f_{middle}$ may correspond to a center frequency.

In a case in which the frequency of the second feeding signal is a low frequency $f_{low}$ which is lower than the middle frequency $f_{middle}$, the radiating element 112 may radiate the radio wave in a direction skewed toward the antenna device 50. For example, when defining the direction vertical to the antenna device 50 in the elevation (vertical) direction of the antenna device 50 as a reference axis, the radiating element 112 may radiate the radio wave in a direction skewed at a negative angle from the reference axis as the frequency of the second feeding signal is relatively low.

In a case in which the frequency of the second feeding signal is a high frequency $f_{high}$ which is higher than the middle frequency $f_{middle}$, the radiating element 112 may radiate the radio wave in a direction skewed toward the antenna device 50. For example, the radiating element 112 may radiate the radio wave in a direction skewed at a positive angle from the reference axis as the frequency of the second feeding signal is relatively high.

When assuming the electrical beam scanning range of the radiating element 112 is $\pm\theta_1$, a wavelength variation required by the coupled transmission line 113 may be expressed by Equation 1.

$$\Delta\lambda=2\lambda_o(d/s)\sin(\theta_1)\times 0.01[\%] \quad \text{[Equation 1]}$$

In Equation 1, $\Delta\lambda$ denotes the required wavelength variation, $\lambda_o$ denotes a wavelength at the center frequency, d denotes a distance between the radiating element 112 of the first array antenna 110 and a radiating element of the second array antenna 120, s denotes a length of the coupled transmission line 113, and $\theta_1$ denotes the electrical beam scanning range. For example, in a case of $\pm\theta_1=\pm 6.5$ degrees (°), d=16 mm, s=73.2 mm($4.0\lambda_0$), a required fractional bandwidth may be 4.9% ($f_L$=15.99 GHz, $f_o$=16.40 GHz, $f_H$=16.80 GHz).

FIG. 3 describes the operation of the radiating element 112 radiating the radio wave in the vertical (elevation) direction. However, example embodiments are not limited thereto. The radiating element 112 may radiate the radio wave in a horizontal (azimuth) direction using a phase shifter.

The coupled transmission line 113 may transmit the third feeding signal to the second array antenna 120. In this example, the distance d between the radiating element 112 of the first array antenna 110 and the radiating element of the second array antenna 120 may be limited, and the coupled transmission line 113 may be coupled such that the length thereof may be an integer multiple of the wavelength $\lambda_0$ at the center frequency, that is, $n\cdot\lambda_0$, n being an integer. In this example, as a value of n increases, the electrical beam scanning range of the radiating element 112 may increase. For example, the distance between the radiating element 112 of the first array antenna 110 and the radiating element of the second array antenna 120 may be 16 mm ($0.87\lambda_0$), and the length of the coupled transmission line 113 may be 73.2 mm ($4\lambda_0$).

The coupled transmission line 113 may transmit the third feeding signal to the second array antenna 120 in a transverse electromagnetic (TEM) mode. That is, the antenna device 50 may further include an upper metallic body and a lower metallic body to fill a portion excluding a line width of the coupled transmission line 113 with air. For example, the upper metallic body and the lower metallic body may include grooves to dispose the coupled transmission line 113 in the air.

Referring to FIG. 2C, the last array antenna of the antenna device 50, that is, the N-th array antenna 130, may be connected to a radiating element 140. That is, the antenna device 50 may include N T-junctions, (N+1) radiating elements, and N coupled transmission lines.

Referring to FIG. 2D, a structure of the antenna device 50 is illustrated. The antenna device 50 may further include a transmission line 101 that receives the first feeding signal and transmits the first feeding signal to the first array antenna 110. The radiating elements 110, 120, . . . , 130 of the plurality of array antennas and the radiating element 140 may radiate radio waves based on the first feeding signal.

Figure 4A:
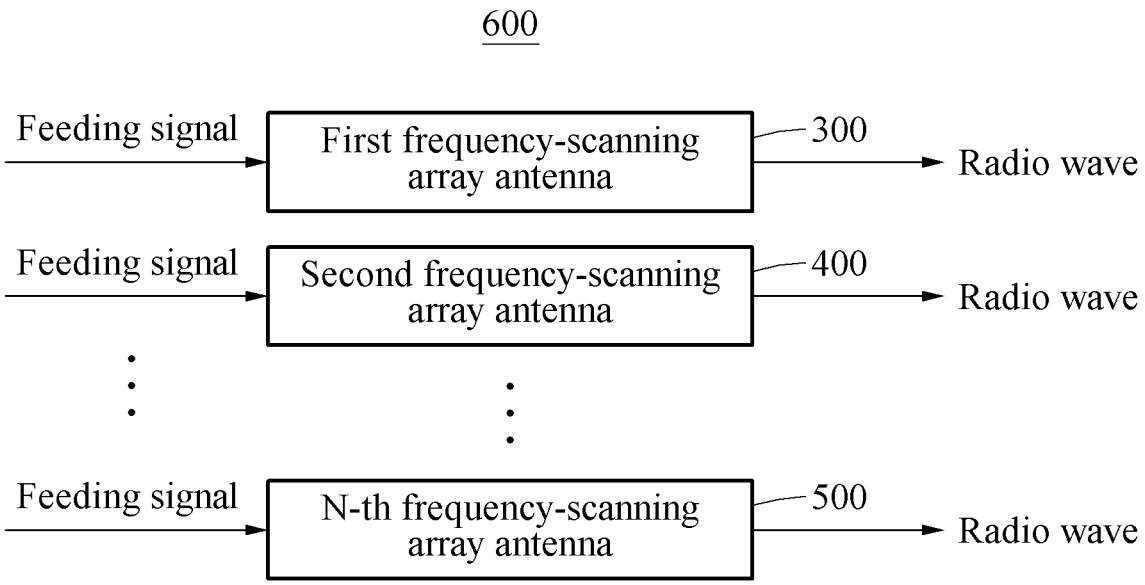
FIG. 4A is a block diagram illustrating an antenna device according to an example embodiment.
Figure 4B:
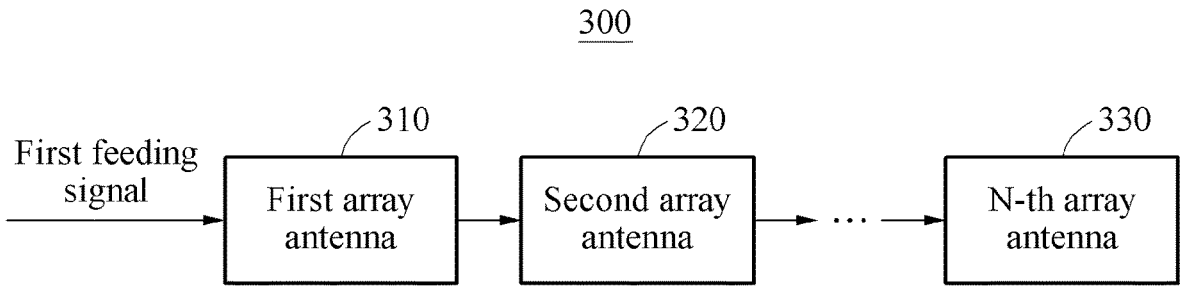
FIG. 4B is a block diagram illustrating an example of a first frequency-scanning array antenna of FIG. 4A.
Figure 5A:
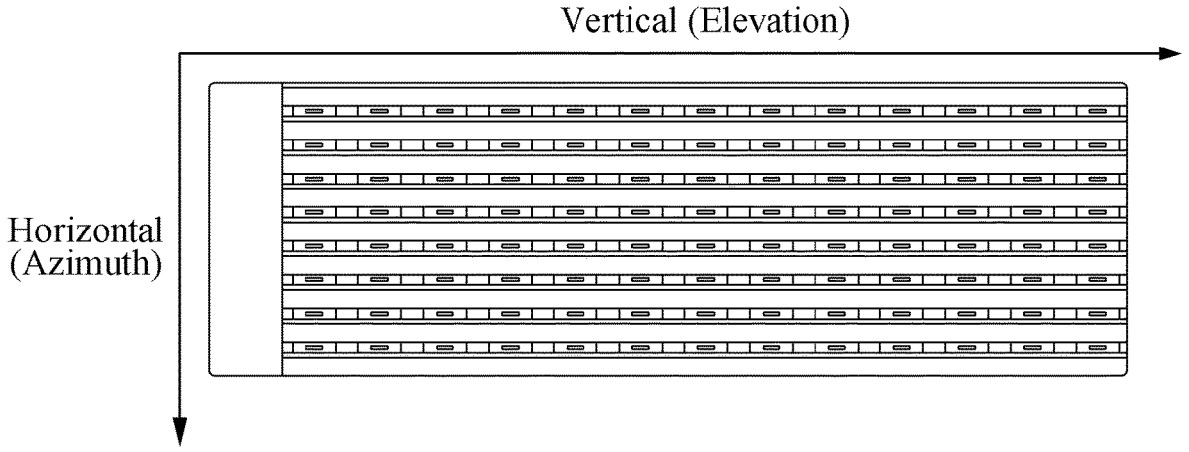
FIG. 5A illustrates a front side of the antenna device of FIG. 4A.
Figure 5B:
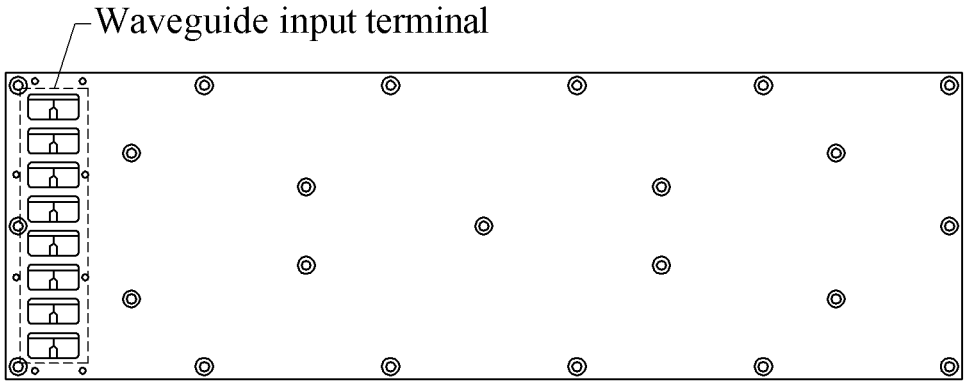
FIG. 5B illustrates a rear side of the antenna device of FIG. 4A.
Figure 5C:
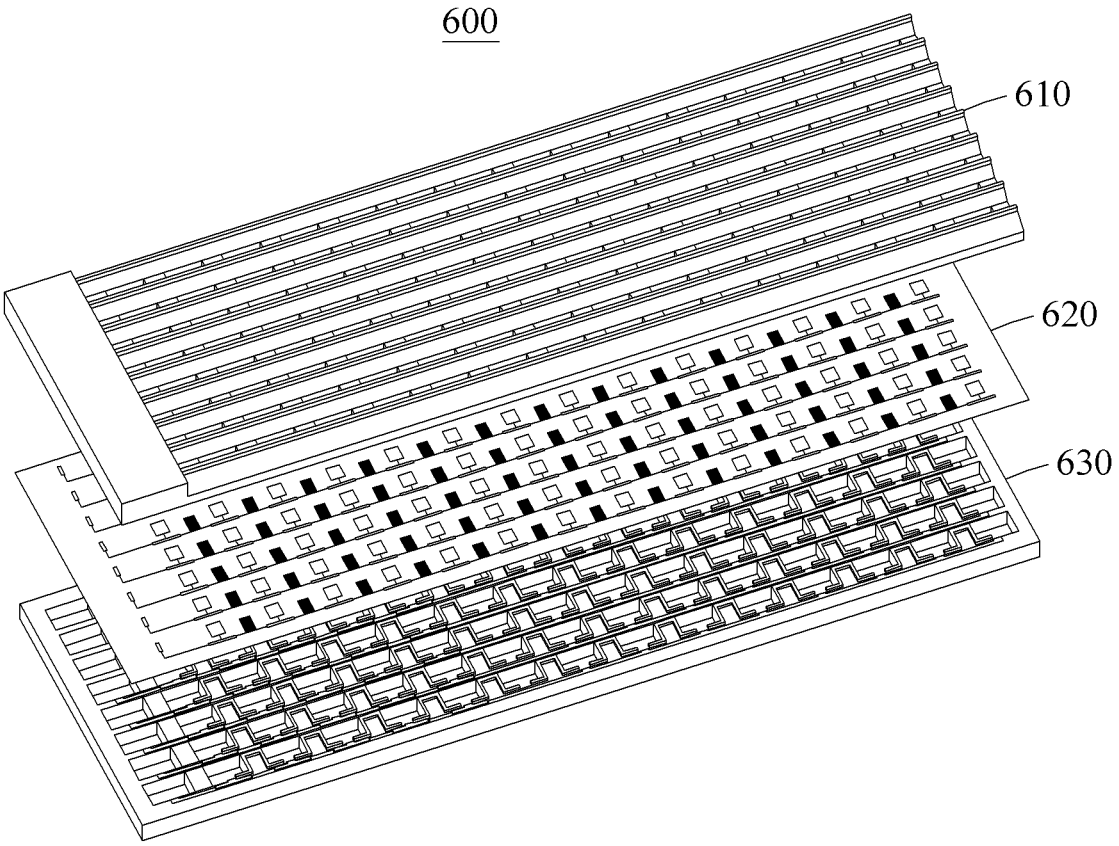
FIG. 5C illustrates a structure of the antenna device of FIG. 4A.

FIG. 4A is a block diagram illustrating an antenna device according to an example embodiment, FIG. 4B is a block diagram illustrating an example of a first frequency-scanning array antenna of FIG. 4A, FIG. 5A illustrates a front side of the antenna device of FIG. 4A, FIG. 5B illustrates a rear side of the antenna device of FIG. 4A, and FIG. 5C illustrates a structure of the antenna device of FIG. 4A.

Referring to FIGS. 4A through 5C, an antenna device 600 may be a linear slot array antenna for broadly scanning a frequency. The antenna device 600 may include a plurality of frequency-scanning array antennas disposed in parallel. The plurality of frequency-scanning array antennas may include a first frequency-scanning array antenna 300, a second frequency-scanning array antenna 400, . . . , an N-th frequency-scanning array antenna 500. The first frequency-scanning array antenna 300, the second frequency-scanning array antenna 400, . . . , the N-th frequency-scanning array antenna 500 may radiate radio waves based on feeding signals. In this example, the feeding signals respectively input into the first frequency-scanning array antenna 300, the second frequency-scanning array antenna 400, . . . , the N-th frequency-scanning array antenna 500 may have the same frequency or different frequencies.

Hereinafter, a structure of the first frequency-scanning array antenna 300 will be described with reference to FIG. 4B. The structure of the first frequency-scanning array antenna 300 may be applicable to structures of the second frequency-scanning array antenna 400, . . . , the N-th frequency-scanning array antenna 500.

The first frequency-scanning array antenna 300 may be designed to have a 25-decibel (dB) Chebyshev distribution characteristic to obtain a low side-lobe level characteristic.

The first frequency-scanning array antenna 300 may radiate a radio wave based on a first feeding signal. The first frequency-scanning array antenna 300 may include a first array antenna 310, a second array antenna 320, . . . , an N-th array antenna 330. The first array antenna 310, the second array antenna 320, . . . , the N-th array antenna 330 of the first frequency-scanning array antenna 300 may be substantially the same as the first array antenna 110, the second array antenna 120, . . . , the N-th array antenna 130 of FIG. 2B in terms of configuration and operation. Thus, description of the first array antenna 310, the second array antenna 320, . . . , the N-th array antenna 330 of the first frequency-scanning array antenna 300 will be omitted for conciseness.

An example of implementing the antenna device 600 in practice is shown in FIGS. 5A through 5C. The antenna device 600 may perform frequency scanning in a horizonal (azimuth) direction and a vertical (elevation) direction.

The antenna device 600 may include eight frequency-scanning array antennas. That is, N in the antenna device 600 may be "8". The first frequency-scanning array antenna 300, the second frequency-scanning array antenna 400, . . . , the N-th frequency-scanning array antenna 500 may be arranged in parallel in a horizontal (azimuth) direction.

Further, the first frequency-scanning array antenna 300 may include fourteen array antennas. That is, N in the antenna device 600 may be "14". A first array antenna, a second array antenna, . . . , a fourteenth array antenna in each of the frequency-scanning array antennas may be arranged in series in a vertical (elevation) direction. The antenna device 600 may receive a feeding signal through a waveguide input terminal on a rear side thereof.

The antenna device 600 may include an upper utensil 610, a dielectric film layer 620, and a lower utensil 630.

The upper metallic body 610 and the lower metallic body 630 may include a plurality of grooves to fill a portion excluding a line width in the dielectric film layer 620 with air. Thus, a coupled transmission line of the dielectric film layer 620 may transmit a feeding signal in a TEM mode.

The upper metallic body 610 may be disposed on the dielectric film layer 620, and include grooves corresponding to array antennas of the dielectric film layer 620.

The dielectric film layer 620 may include the array antennas described with reference to FIGS. 1 through 3. That is, the dielectric film layer 620 may include a T-junction, a radiating element, and a coupled transmission line.

The lower metallic body 630 may be disposed beneath the dielectric film layer 620, and include grooves corresponding to the array antennas of the dielectric film layer 620.

Hereinafter, the upper metallic body 610, the dielectric film layer 620, and the lower utensil 630 will be described separately.

Figure 6A:
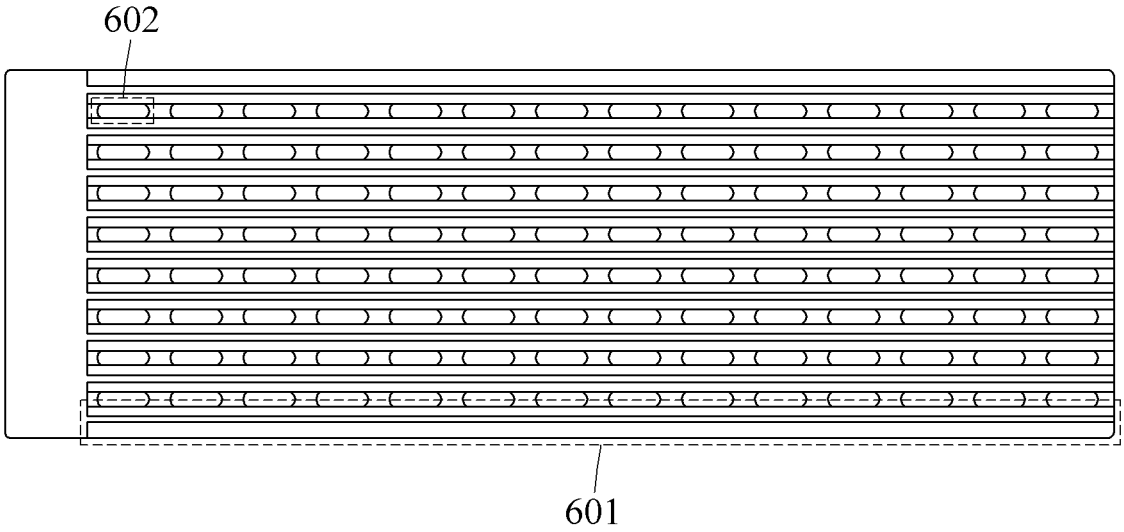
FIG. 6A illustrates a front side of an upper metallic body.
Figure 6B:
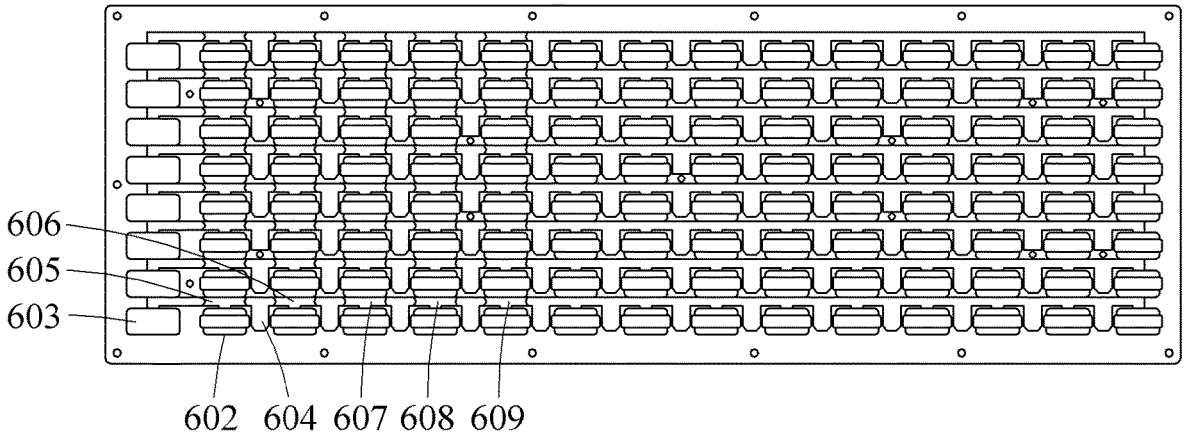
FIG. 6B illustrates a rear side of an upper metallic body.
Figure 7:
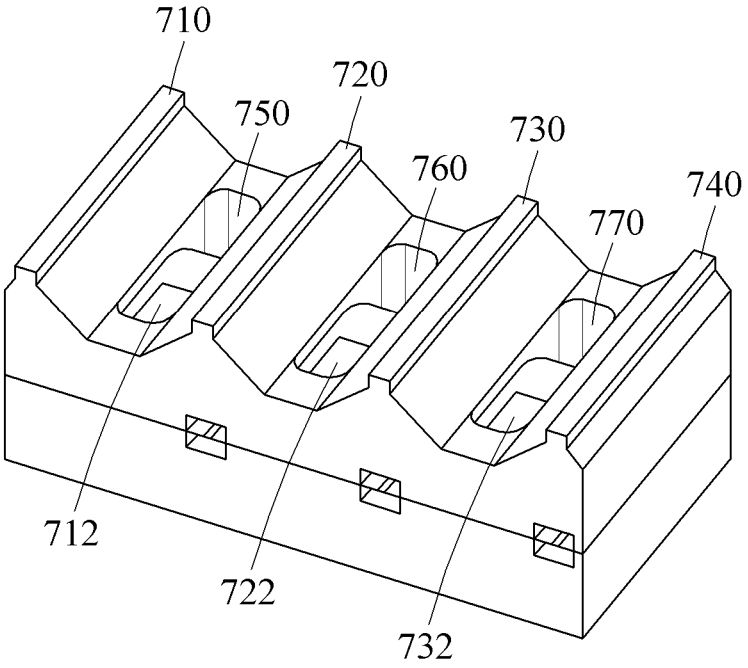
FIG. 7 illustrates a wedge structure of an upper metallic body.
Figure 8:
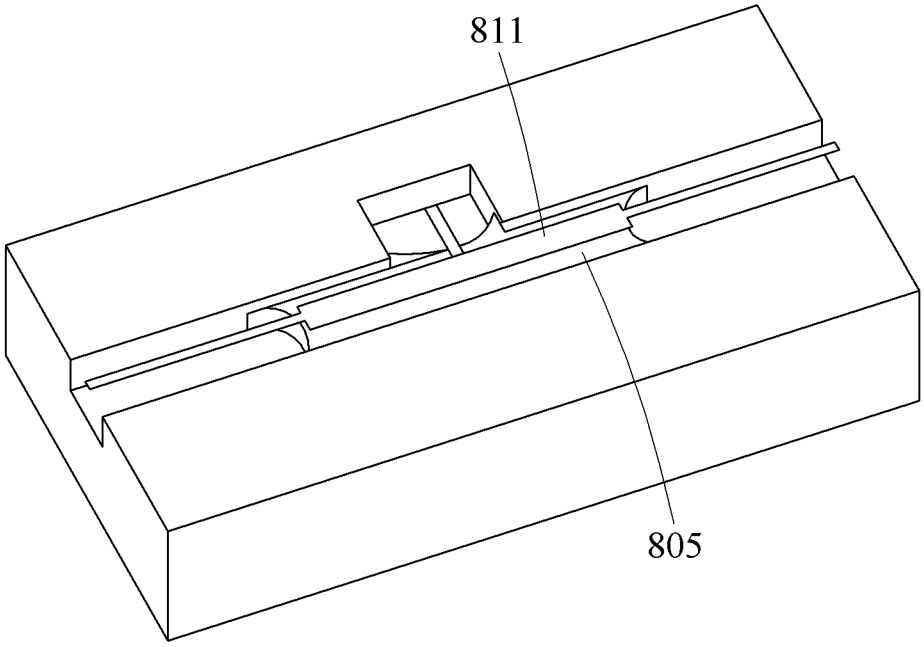
FIG. 8 illustrates grooves of an upper metallic body.

FIG. 6A illustrates a front side of an upper metallic body, FIG. 6B illustrates a rear side of the upper metallic body, FIG. 7 illustrates a wedge structure of the upper metallic body, and FIG. 8 illustrates grooves of the upper metallic body.

Referring to FIG. 6A, the upper metallic body 610 may include a wedge structure 601 and a slot 602 on a front side thereof.

The wedge structure 601 may have a trapezoidal shape. That is, the wedge structure 601 may be formed in a shape of "V" based on the slot 602. The upper metallic body 610 may include (M+1) wedge structures 601 with respect to M frequency-scanning array antennas. For example, in a case in which a number of the frequency-scanning array antennas is "8", a number of the wedge structures 601 may be "9".

The upper metallic body 610 may include M*N slots 602. M may be a total number of frequency-scanning array antennas, and N may be a total number of array antennas included in each frequency-scanning array antenna.

The slot 602 may be a portion that penetrates the front side and the rear side of the upper metallic body 610 such that a radiating element of a dielectric film layer may radiate a radio wave. Since the radiating element radiates the radio wave through the slot 602, the antenna device 600 may have an excellent directivity, thereby improving a mutual coupling characteristic.

Referring to FIG. 7, slots 750, 760, and 770 may be disposed between wedge structures 710, 720, 730, and 740. For example, the slot 750 may be disposed between the wedge structure 710 and the wedge structure 720. The slot 760 may be disposed between the wedge structure 720 and the wedge structure 730. The slot 770 may be disposed between the wedge structure 730 and the wedge structure 740. The wedge structures 710, 720, 730, and 740 may be formed in shapes of "V" based on the slots 750, 760, and 770.

The slots 750, 760, and 770 may be portions through which radiating elements 712, 722, and 732 of a dielectric film layer radiate radio waves. That is, the radiating element 712 may radiate a radio wave through the slot 750, the radiating element 722 may radiate a radio wave through the slot 760, and the radiating element 732 may radiate a radio wave through the slot 770.

Referring to FIG. 6B, the upper metallic body 610 may include the slot 602, a first groove 603, a second groove 604, and third grooves 605, 606, 607, 608, and 609 on a rear side thereof.

The first groove 603 may be a portion through which a waveguide input terminal of the dielectric film layer receives a feeding signal. That is, the first groove 603 may be a waveguide upper cover portion. An array space in a horizontal (azimuth) direction in the upper metallic body 610 may be limited. Thus, the first groove 603 may be disposed to rotate 90 degrees (°). That is because a length of a major axis of a waveguide may be greater than the array space in the horizontal (azimuth) direction in the upper metallic body 610.

The second groove 604 may be a portion through which a coupled transmission line of the dielectric film layer transmits the feeding signal in a TEM mode. For example, the second groove 604 may fill a portion excluding the coupled transmission line of the dielectric film layer with air.

The third groove 605, 606, 607, 608, and 609 may be portions through which a T-junction of the dielectric film layer equally distributes the feeding signal. In this example, for the T-junction of the dielectric film layer to equally distribute the feeding signal to each radiating element, a coupled transmission line of a relatively low characteristic impedance may be required as a distance to the first groove 603 is relatively close in a vertical (elevation) direction, in view of a side-lobe characteristic of the vertical (elevation) direction and a linear array distribution characteristic thereof. That is, among the third groove 605, 606, 607, 608, and 609, a groove relatively close to the first groove 603 in the vertical (elevation) direction may have a relatively shallow depth.

Referring to FIG. 8, the upper metallic body 610 may further include a groove structure 805. The upper metallic body 610 may adjust depths of third grooves using the groove structure 805. For example, a height of the groove structure 805 may increase toward a first groove in a vertical (elevation) direction. That is, a third groove relatively close to the first groove in the vertical (elevation) direction may have a relatively shallow depth. Thus, a characteristic impedance of the coupled transmission line may decrease toward the first groove in the vertical (elevation) direction.

A T-junction 811 of the dielectric film layer may distribute the feeding signal while not contacting the groove structure 805 but maintaining a predetermined space therefrom.

Figure 9A:
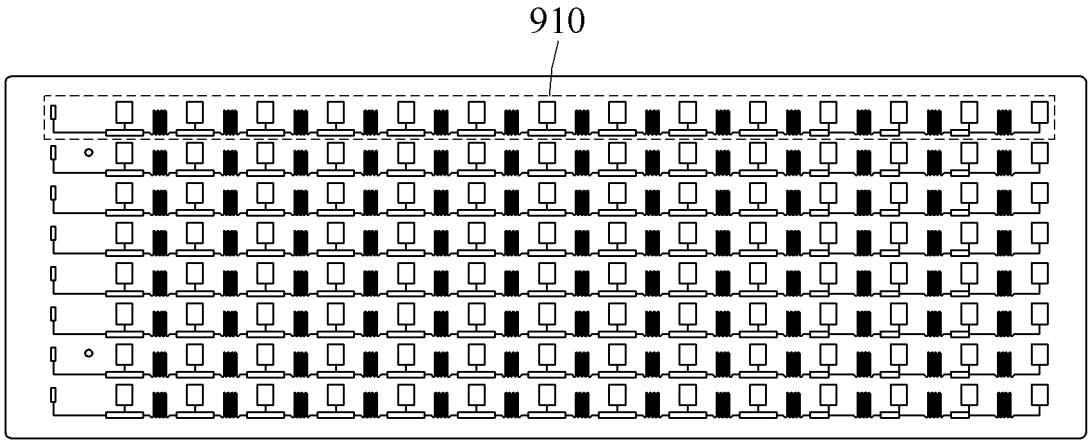
FIG. 9A illustrates a dielectric film layer.
Figure 9B:
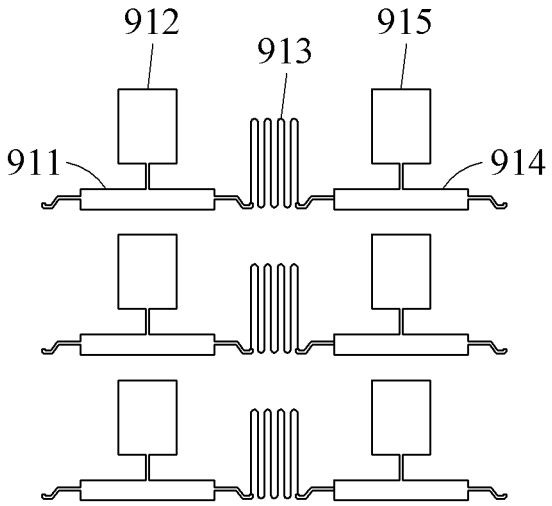
FIG. 9B illustrates T-junctions, radiating elements, and a coupled transmission line on the dielectric film layer of FIG. 9A.

FIG. 9A illustrates a dielectric film layer, and FIG. 9B illustrates T-junctions, radiating elements, and a coupled transmission line on the dielectric film layer of FIG. 9A.

Referring to FIG. 9A, a dielectric film layer may include a plurality of frequency-scanning array antennas including a frequency-scanning array antenna 910. The frequency-scanning array antenna 910 may include a waveguide input terminal and a plurality of array antennas connected in series.

The dielectric film layer may include the waveguide input terminal, and thus may not require an additional SubMiniature version A (SMA) connector, thereby having effects such as convenience maintenance, system cost reduction, and weight reduction.

An array antenna may include a T-junction, a first radiating element, and a coupled transmission line. Among the plurality of array antennas, a last array antenna may be connected to a second radiating element. The first radiating element and the second radiating element may be substantially the same in terms of configuration and operation.

Referring to FIG. 9B, T-junctions 911 and 914, radiating elements 912 and 915, and a coupled transmission line 913 of the frequency-scanning array antenna 910 are illustrated.

Figure 10A:
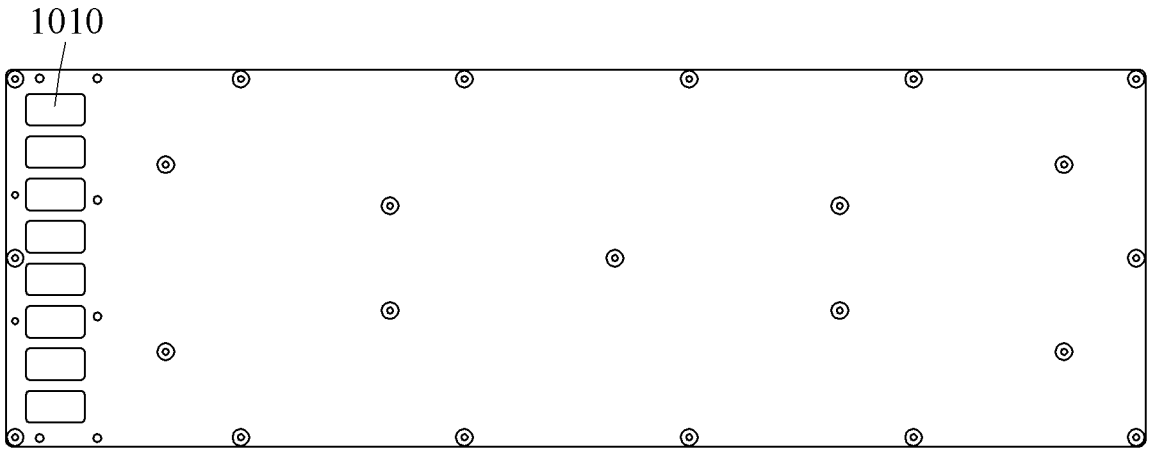
FIG. 10A illustrates a front side of a lower metallic body.
Figure 10B:
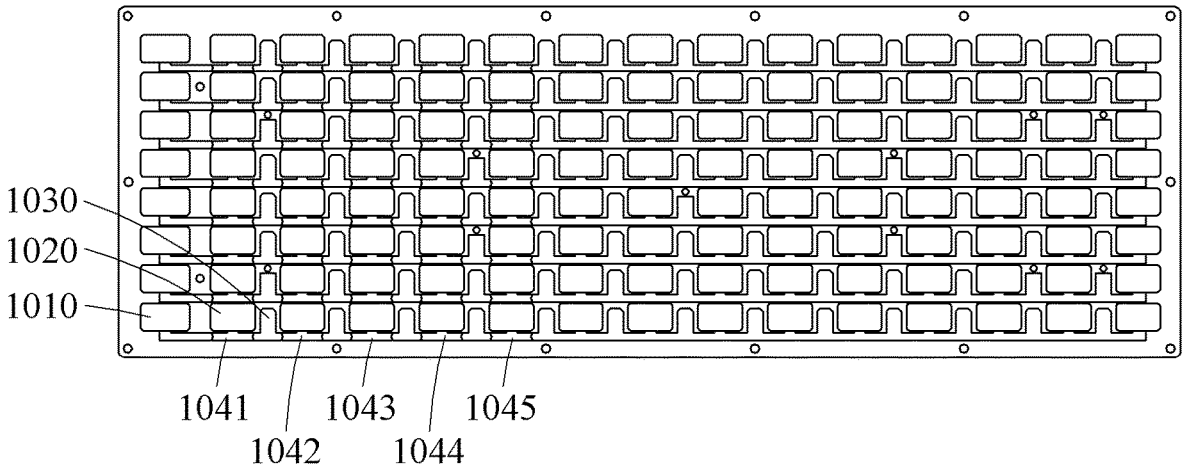
FIG. 10B illustrates a rear side of a lower metallic body.

FIG. 10A illustrates a front side of a lower utensil, and FIG. 10B illustrates a rear side of the lower metallic body.

Referring to FIG. 10A, the lower metallic body 630 may include a waveguide aperture 1010 on a front side. The waveguide aperture 1010 may be a portion that penetrates the front side and the rear side of the lower metallic body 630 such that a feeding signal may be input into a waveguide input terminal of the dielectric film layer. An array space in a horizontal (azimuth) direction in the lower metallic body 630 may be limited. Thus, the waveguide aperture 1010 may be disposed to rotate 90 degrees (°). That is because a length of a major axis of a waveguide may be greater than the array space in the horizontal (azimuth) direction in the lower metallic body 630. That is, the waveguide aperture 1010 may be a portion corresponding to the first groove 603 in the upper metallic body 610 of FIG. 6B.

Referring to FIG. 10B, the lower metallic body 630 may include the waveguide aperture 1010, a fourth groove 1020, a fifth groove 1030, and sixth grooves 1041, 1042, 1043, 1044, and 1045 on a rear side thereof.

The fourth groove 1020 may be a portion through which a radiating element of the dielectric film layer radiates a radio wave. That is, the fourth groove 1020 may be a portion corresponding to the slot 602 in the upper metallic body 610 of FIG. 6B.

The fifth groove 1030 may be a portion through which a coupled transmission line of the dielectric film layer transmits a feeding signal in a TEM mode. That is, the fifth groove 1030 may be a portion corresponding to the second groove 604 in the upper metallic body 610 of FIG. 6B. The second groove 604 of the upper metallic body 610 and the fifth groove 1030 of the lower metallic body 630 may fill a portion excluding the coupled transmission line of the dielectric film layer with air.

The sixth grooves 1041, 1042, 1043, 1044, and 1045 may be portions through which a T-junction of the dielectric film layer equally distributes the feeding signal. In this example, for the T-junction of the dielectric film layer to equally distribute the feeding signal to each radiating element, a coupled transmission line of a relatively low characteristic impedance may be required as a distance to the waveguide aperture 1010 is relatively close in a vertical (elevation) direction, in view of a side-lobe characteristics of the vertical (elevation) direction and a linear array distribution characteristic thereof. That is, among the sixth grooves 1041, 1042, 1043, 1044, and 1045, a groove relatively close to the waveguide aperture 1010 in the vertical (elevation) direction may have a relatively shallow depth. The description provided with reference to FIG. 8 may also be applicable thereto. That is, the lower metallic body 630 may include a groove structure that adjusts depths of the sixth grooves 1041, 1042, 1043, 1044, and 1045.

Figure 11A:
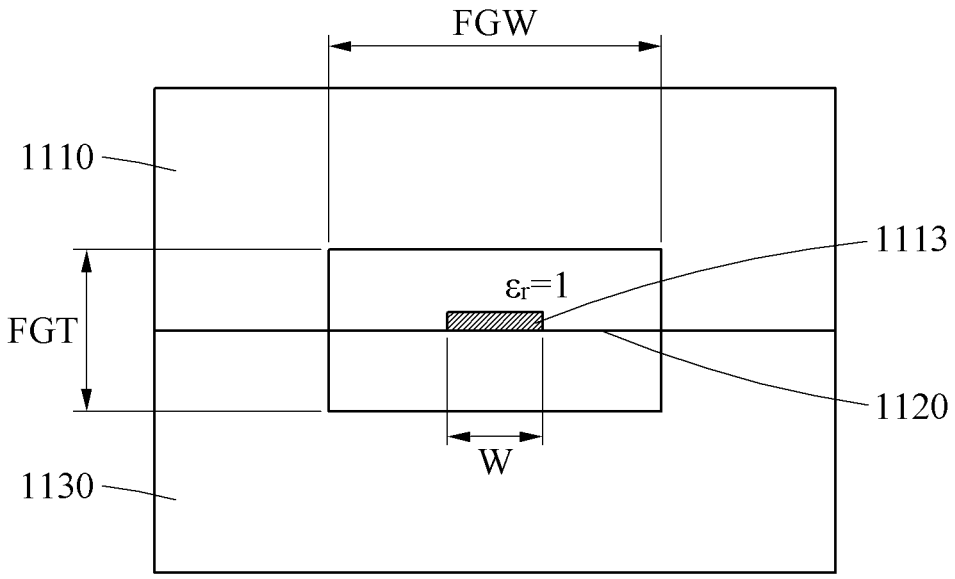
FIG. 11A illustrates an example of a structure of an airstrip transmission line.
Figure 11B:
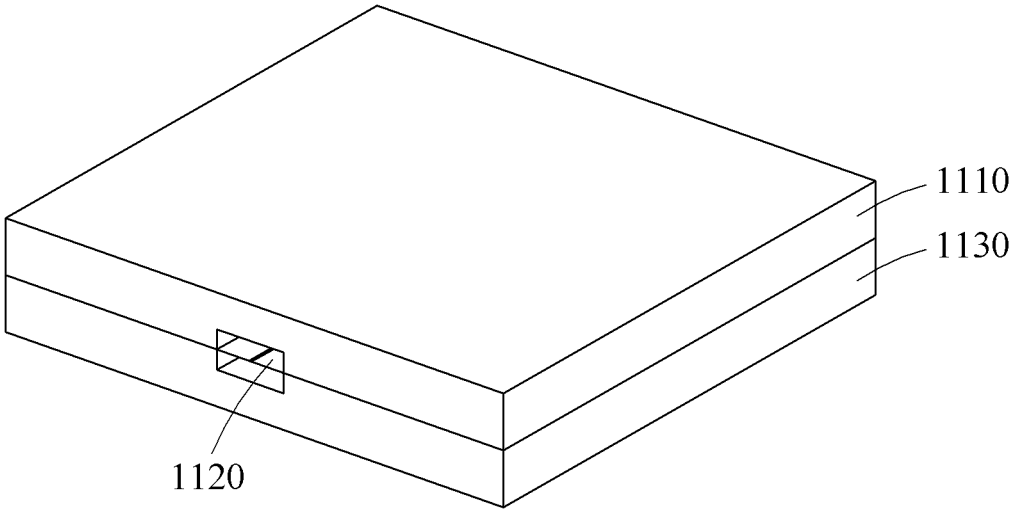
FIG. 11B illustrates an example of a structure of an airstrip transmission line.
Figure 12:
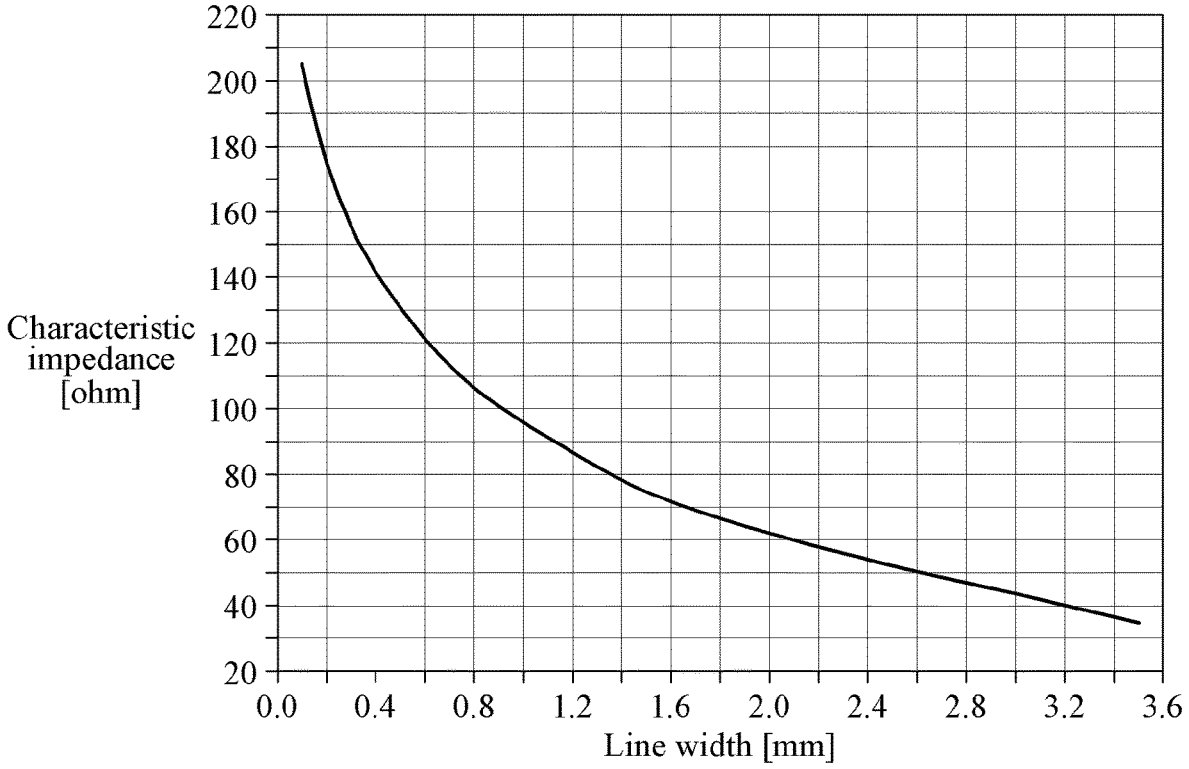
FIG. 12 is a graph illustrating a relationship between a characteristic impedance and a width of an airstrip transmission line.

FIG. 11A illustrates an example of a structure of an airstrip transmission line, FIG. 11B illustrates an example of the structure of the airstrip transmission line, and FIG. 12 is a graph illustrating a relationship between a characteristic impedance and a width of an airstrip transmission line.

Referring to FIGS. 11A and 11B, an antenna device implemented in a structure of an airstrip transmission line is illustrated.

The antenna device may include an upper metallic body 1110, a dielectric film layer 1120, and a lower metallic body 1130. The description provided with reference to FIGS. 6A through 10B may be applicable to the upper metallic body 1110, the dielectric film layer 1120, and the lower metallic body 1130.

The dielectric film layer 1120 may include an airstrip transmission line 1113 with a width w. The airstrip transmission line 1113 may be a coupled transmission line.

The upper metallic body 1110 may include a second groove such that the airstrip transmission line 1113 may transmit a feeding signal in a TEM mode. That is, the upper metallic body 1110 may fill a portion excluding the airstrip transmission line 1113 of the dielectric film layer 1120 with air. A relative permittivity $\varepsilon_r$ of the air may be "1".

The lower metallic body 1130 may include a fifth groove such that the airstrip transmission line 1113 may transmit the feeding signal in the TEM mode. That is, the upper metallic body 1110 may fill a portion excluding the airstrip transmission line 1113 of the dielectric film layer 1120 with air.

The upper metallic body 1110 and the lower metallic body 1130 may provide an air gap with a cross-section of width FGW*height FGT to the dielectric film layer 1120 using the second groove and the fifth groove. For example, the second groove may have a width of FGW and a depth of (FGT/2), and the fifth groove may have a width of FGW and a depth of (FGT/2).

Thus, a dielectric loss by a loss tangent characteristic of the dielectric film layer 1120 may be reduced, and a feeding loss may be minimized.

Referring to FIG. 12, a change in the characteristic impedance with respect to the width w of the airstrip transmission line 1113, in a case of setting the width FGW of the air gap to 4.0 mm and the height FGT of the air gap to 2.0 mm, is illustrated. As the width w of the airstrip transmission line 1113 increases, the characteristic impedance of the airstrip transmission line 1113 may decrease non-linearly.

The characteristic impedance of the airstrip transmission line 1113 may be more sensitive to a change in the height FGT than a change in the width FGW. Thus, as described with reference to FIG. 8, by adjusting the depths of the second groove and the fifth groove using the groove structure, a characteristic impedance of each array antenna may be adjusted.

A method of improving a phase dispersion characteristic by increasing a series feeding length between radiating elements in an antenna device will be described with reference to FIGS. 13 through 16.

Figure 13:
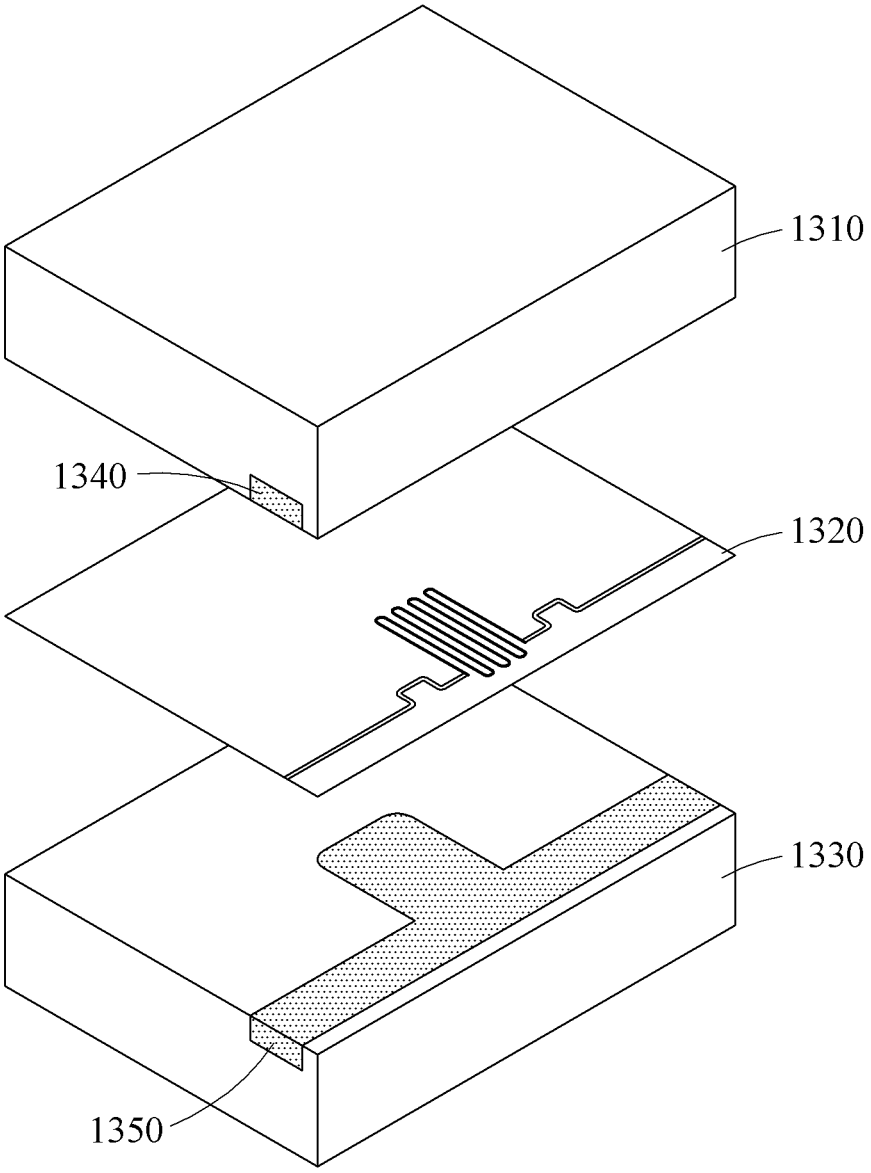
FIG. 13 illustrates an example of a method of improving a phase dispersion characteristic in an antenna device.

FIG. 13 illustrates an example of a method of improving a phase dispersion characteristic in an antenna device.

Referring to FIG. 13, an antenna device may include an upper metallic body 1310, a dielectric film layer 1320, and a lower metallic body 1330. In this example, the upper metallic body 1310 may include a first dielectric 1340 in a second groove to increase a permittivity of the first dielectric 1340. The lower metallic body 1330 may include a second dielectric 1350 in a fifth groove to increase a permittivity of the second dielectric 1350.

The first dielectric 1340 and the second dielectric 1350 may be implemented as high-permittivity dielectrics. Thus, a series feeding length between radiating elements in the antenna device may increase, and thus the antenna device may have an improved phase dispersion characteristic.

Figure 14:
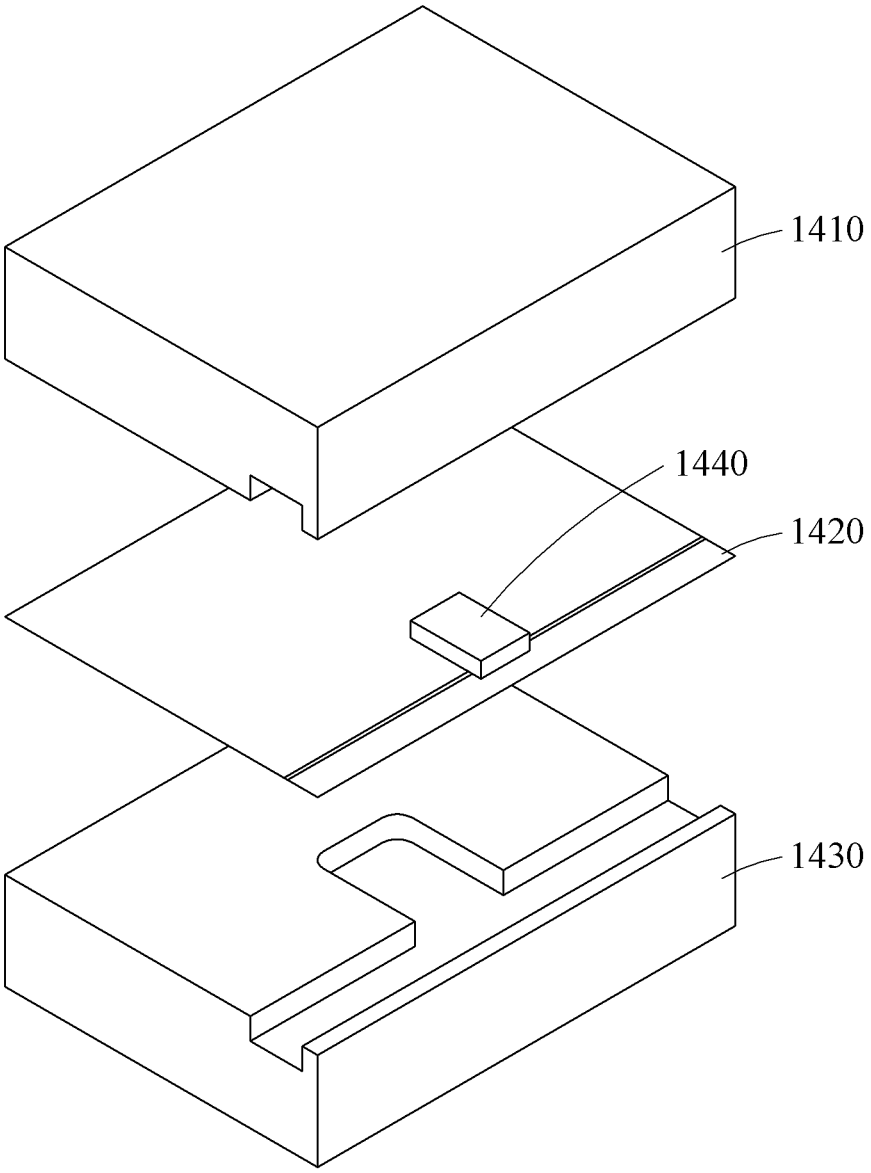
FIG. 14 illustrates an example of a method of improving a phase dispersion characteristic in an antenna device.

FIG. 14 illustrates an example of a method of improving a phase dispersion characteristic in an antenna device.

Referring to FIG. 14, an antenna device may include an upper metallic body 1410, a dielectric film layer 1420, and a lower metallic body 1430. In this example, the dielectric film layer 1420 may include a coupled transmission line implemented using low temperature co-fired ceramic (LTCC) technology or monolithic microwave integrated circuit (MMIC) technology. To implement the coupled transmission line using LTCC technology or MMIC technology, a thin dielectric film layer 1420 or an additional process of assembling the dielectric film layer 1420 on a thin radio frequency printed circuit board (RF PCB) may be needed. Thus, a series feeding length between radiating elements in the antenna device may increase, and thus the antenna device may have an improved phase dispersion characteristic.

Figure 15A:
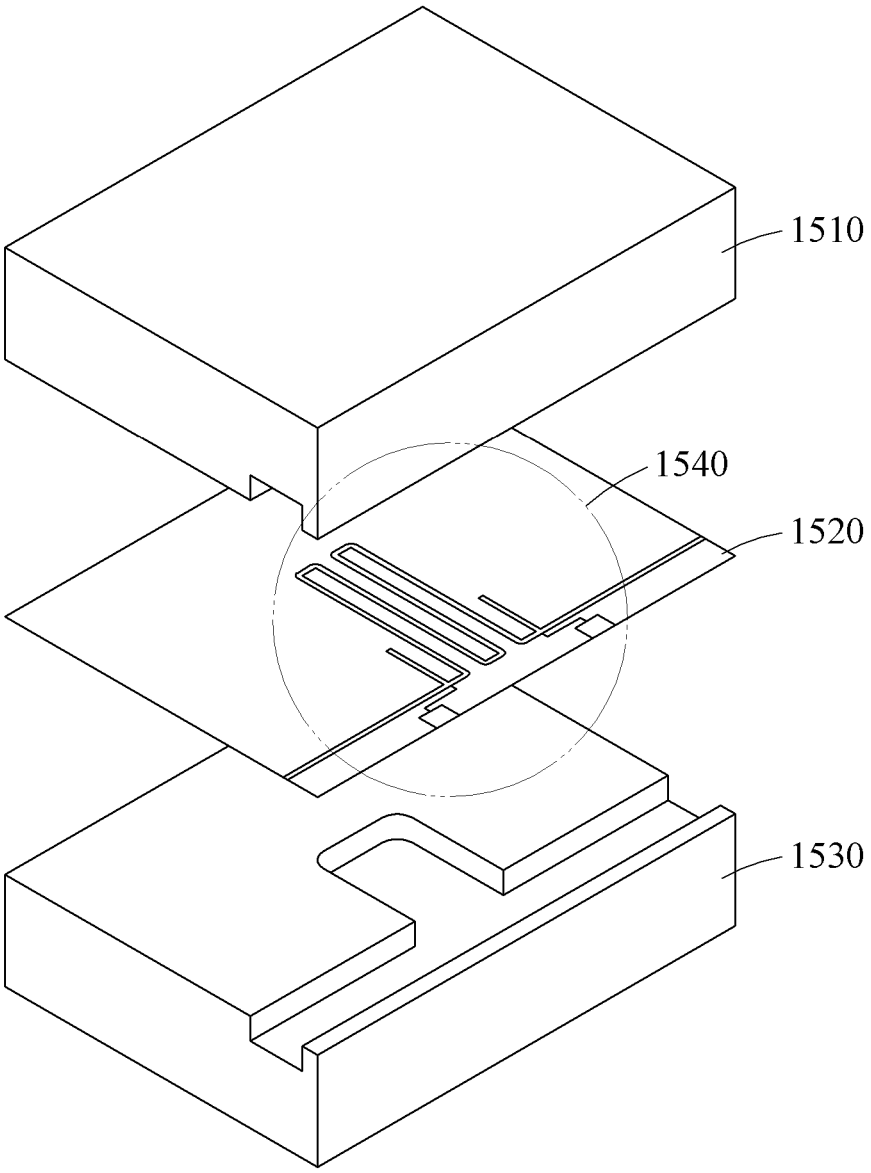
FIG. 15A illustrates an example of a method of improving a phase dispersion characteristic in an antenna device.
Figure 15B:
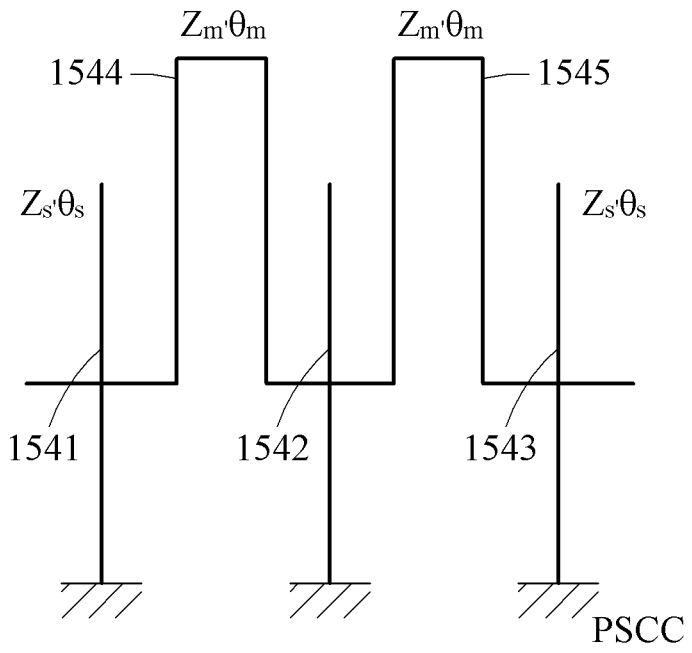
FIG. 15B illustrates an example of a phase slope control circuit (PSCC) of FIG. 15A.
Figure 16:
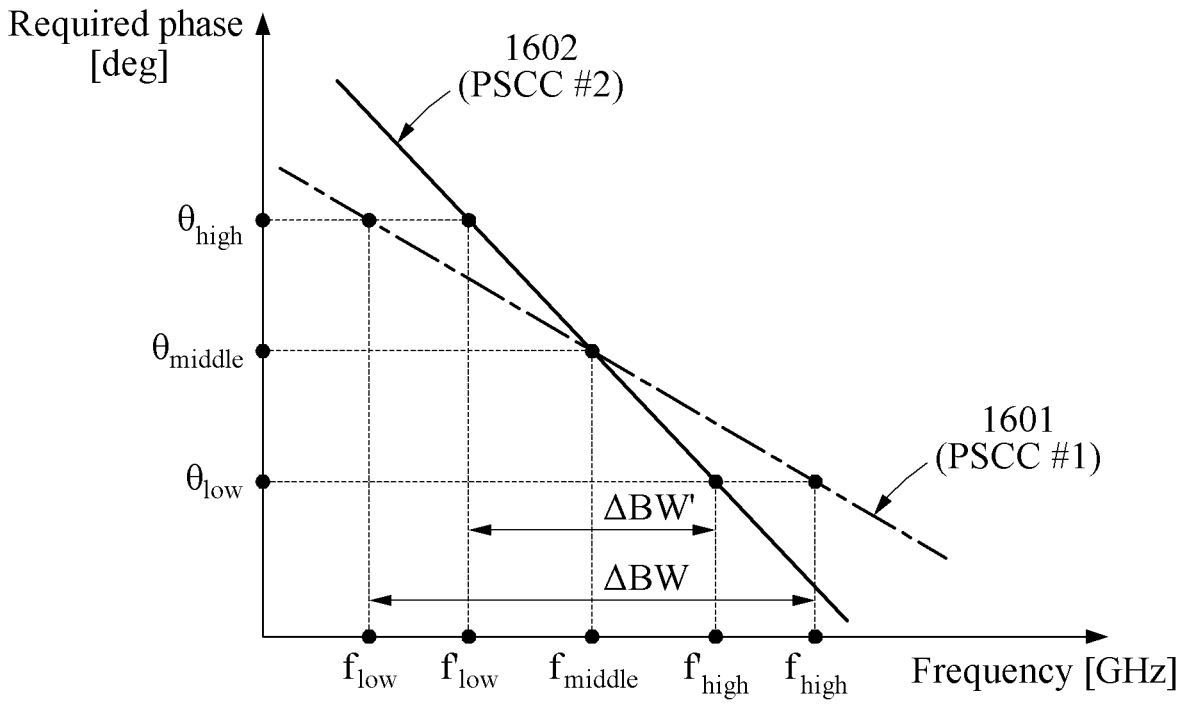
FIG. 16 illustrates a relationship between a frequency bandwidth and an electrical beam scanning range.

FIG. 15A illustrates an example of a method of improving a phase dispersion characteristic in an antenna device, FIG. 15B illustrates an example of a phase slope control circuit (PSCC) of FIG. 15A, and FIG. 16 illustrates a relationship between a frequency bandwidth and an electrical beam scanning range.

Referring to FIGS. 15A and 15B, an antenna device may include an upper metallic body 1510, a dielectric film layer 1520, and a lower metallic body 1530. In this example, the dielectric film layer 1520 may include a PSCC 1540.

The PSCC 1540 may include a transmission line and stub lines. The stub lines may include an open stub and a shorted tub that are connected in parallel.

The PSCC 1540 may include a first stub line 1541 having a first characteristic impedance and a first electrical length, a second stub line 1542 having a second characteristic impedance and a second electrical length, and a third stub line 1543 including a third characteristic impedance and a third electrical length. The first characteristic impedance, the second characteristic impedance, and the third characteristic impedance may be $Z_s$. The first electrical length, the second electrical length, and the third electrical length may be $\theta_s$. For example, $\theta_s$ may be $\lambda/4$, that is, 45 degrees (°).

The transmission line may be disposed between stub lines. For example, a first transmission line 1544 having a fourth characteristic impedance and a fourth electrical length may be disposed between the first stub line 1541 and the second stub line 1542. Further, a second transmission line 1545 having a fifth characteristic impedance and a fifth electrical length may be disposed between the second stub line 1542 and the third stub line 1543. The fourth characteristic impedance and the fifth characteristic impedance may be $Z_m$. The fourth electrical length and the fifth electrical length may be $\theta_m$. For example, $\theta_m$ may be $\lambda$, that is, 180 degrees (°).

Referring to FIG. 16, it may be verified that a frequency bandwidth required by a PSCC #2 1602 is narrower than a frequency bandwidth required by a PSCC #1 1601 with respect to the same electrical beam scanning range. For example, the PSCC 1601 may require a frequency bandwidth of $f_{low}$ to $f_{high}$ in an electrical beam scanning range of $\theta_{low}$ to $\theta_{high}$. The PSCC 1602 may require a frequency bandwidth of $f_{low}$ to $f_{high}$ in the electrical beam scanning range of $\theta_{low}$ to $\theta_{high}$. The frequency bandwidth of $f'_{low}$ to $f'_{high}$ may be narrower than the frequency bandwidth of $f_{low}$ to $f_{high}$. The PSCC 1602 may include more transmission lines and stub lines that are connected in series than the PSCC 1601. Thus, a series feeding length between radiating elements in an antenna device including the PSCC 1602 may increase, and thus the antenna device may have an improved phase dispersion characteristic.

Figure 17:
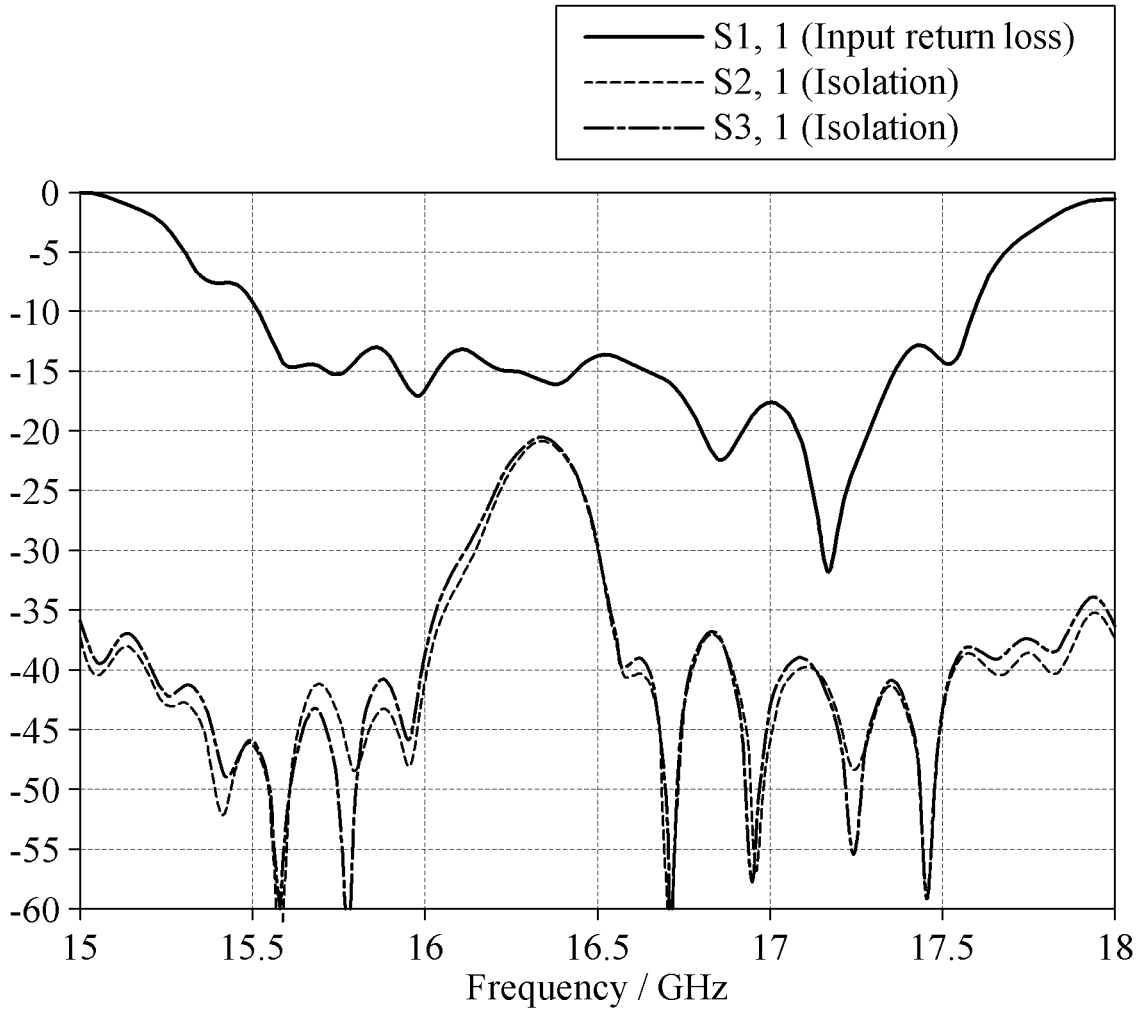
FIG. 17 illustrates an example of a graph representing an electrical characteristic of an antenna device.
Figure 18:
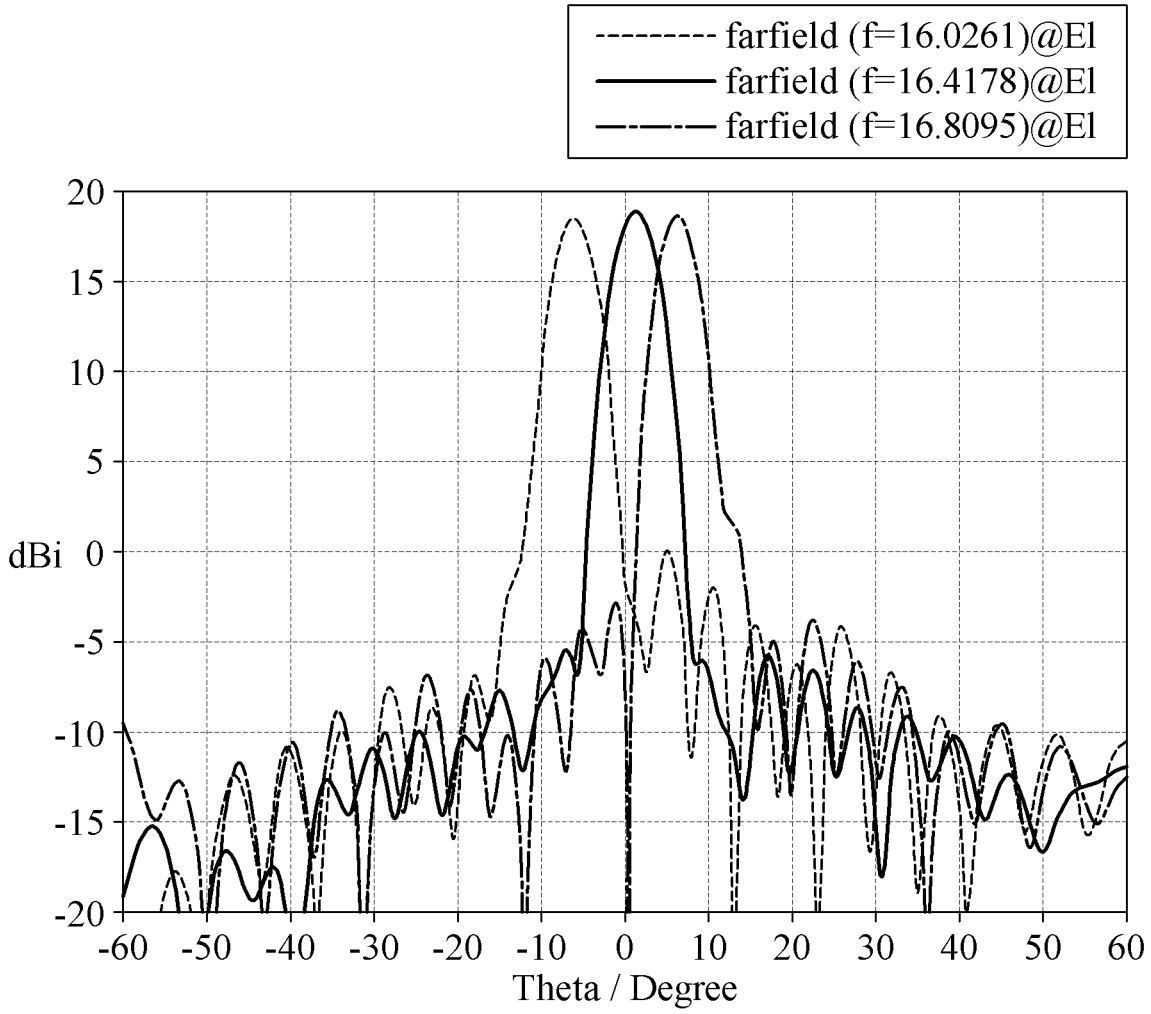
FIG. 18 illustrates an example of a graph representing an electrical characteristic of an antenna device.

FIG. 17 illustrates an example of a graph representing an electrical characteristic of an antenna device, and FIG. 18 illustrates an example of a graph representing an electrical characteristic of an antenna device.

Referring to FIG. 17, an input return loss and inter-terminal isolation characteristics of an antenna device are illustrated. S1,1 denotes the input return loss, and S2,1 and S3,1 denote the inter-terminal isolation characteristics.

It may be verified that the input return loss and the mutual isolation characteristics of the antenna device exhibit good characteristics, for example, more than 13.3 dB and more than 20.5 dB, respectively, within a designed operating band of 16.0 to 16.8 GHz.

Referring to FIG. 18, a frequency-scanning radiation characteristic of an antenna device is illustrated.

An antenna gain of the antenna device may be greater than or equal to about 18 dBi, and a 3-dB beam width in a vertical (elevation) direction may be 5.0 degrees (°) on average. Further, it may also be verified that the antenna device exhibits an electrical beam scanning radiation characteristic of −6.0 to +6.4 degrees (°) in the frequency-scanning range of 16.0 to 16.8 GHz. This may be the same as expressed by Equation 1.

The components described in the exemplary embodiments of the present invention may be achieved by hardware components including at least one Digital Signal Processor (DSP), a processor, a controller, an Application Specific Integrated Circuit (ASIC), a programmable logic element such as a Field Programmable Gate Array (FPGA), other electronic devices, and combinations thereof. At least some of the functions or the processes described in the exemplary embodiments of the present invention may be achieved by software, and the software may be recorded on a recording medium. The components, the functions, and the processes described in the exemplary embodiments of the present invention may be achieved by a combination of hardware and software.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

The software may include a computer program, a piece of code, an instruction, or some combination thereof, to independently or collectively instruct and/or configure the processing device to operate as desired, thereby transforming the processing device into a special purpose processor. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents.

Accordingly, other implementations are within the scope of the following claims.

What is claimed is:

1. An antenna device, comprising:

a T-junction configured to distribute a first feeding signal;

a first radiating element configured to radiate a radio wave based on a second feeding signal; and a coupled transmission line configured to transmit, to a subsequent element, a third feeding signal remaining after subtracting the second feeding signal from the first feeding signal, wherein the coupled transmission line is coupled such that a length thereof is an integer multiple of a wavelength at a center frequency, and the T-junction, the first radiating element, and the coupled transmission line are connected in series to form a series feeding circuit network.

2. The antenna device of claim 1, wherein a number of T-junctions is N, a number of first radiating elements is N+1, and a number of coupled transmission lines is N.

3. The antenna device of claim 1, wherein the antenna device includes a plurality of frequency-scanning array antennas disposed in parallel, and at least one of the plurality of frequency-scanning array antennas comprises the T-junction, the first radiating element, and the coupled transmission line.

4. The antenna device of claim 1, further comprising:

a waveguide input terminal configured to input the first feeding signal.

5. The antenna device of claim 1, wherein the coupled transmission line is implemented using low temperature co-fired ceramic (LTCC) technology or monolithic microwave integrated circuit (MMIC) technology.

6. The antenna device of claim 1, wherein the coupled transmission line comprises a phase slope control circuit (PSCC) including a transmission line and stub lines.

7. The antenna device of claim 6, wherein the stub lines comprise:

a first stub line having a first characteristic impedance and a first electrical length; and a second stub line having a second characteristic impedance and a second electrical length, wherein the transmission line is disposed between the first stub line and the second stub line.

8. The antenna device of claim 7, wherein the first stub line and the second stub line include an open stub and a shorted stub that are connected in parallel.

9. The antenna device of claim 7, wherein the first characteristic impedance and the second characteristic impedance are equal.

10. The antenna device of claim 7, wherein the first electrical length and the second electrical length are 45 degrees.

11. The antenna device of claim 1, wherein the T-junction, the first radiating element, and the coupled transmission line are implemented on a dielectric film layer.

12. The antenna device of claim 11, further comprising:

an upper metallic body disposed on the dielectric film layer, the upper metallic body including grooves corresponding to the T-junction, the first radiating element, and the coupled transmission line; and a lower metallic body disposed beneath the dielectric film layer, the lower metallic body including grooves corresponding to the T-junction, the first radiating element, and the coupled transmission line.

13. The antenna device of claim 12, wherein the upper metallic body comprises:

a first groove configured such that a waveguide input terminal of the dielectric film layer receives the first feeding signal;

a slot configured such that the first radiating element radiates the radio wave; and a second groove configured such that the coupled transmission line transmits the third feeding signal in a transverse electromagnetic (TEM) mode.

14. The antenna device of claim 13, wherein the upper metallic body further comprises:

a third groove configured such that the T-junction equally distributes the first feeding signal, wherein, when the third groove is a groove relatively close to the first groove, a depth thereof is relatively shallow.

15. The antenna device of claim 13, wherein the upper metallic body further comprises:

a first dielectric disposed in the second groove to increase a permittivity thereof.

16. The antenna device of claim 12, wherein the upper metallic body comprises a wedge structure to improve a directivity with respect to the radio wave.

17. The antenna device of claim 12, wherein the lower metallic body comprises:

a waveguide aperture configured to input the first feeding signal into a waveguide input terminal of the dielectric film layer;

a fourth groove configured such that the first radiating element radiates the radio wave; and a fifth groove configured such that the coupled transmission line transmits the third feeding signal in a TEM mode.

18. The antenna device of claim 17, wherein the lower metallic body further comprises:

a sixth groove configured such that the T-junction equally distributes the first feeding signal, wherein, when the sixth groove is a groove relatively close to the waveguide aperture, a depth thereof is relatively shallow.

19. The antenna device of claim 17, wherein the waveguide aperture is disposed to rotate 90 degrees with respect to the waveguide input terminal.

20. The antenna device of claim 17, wherein the lower metallic body further comprises:

a second dielectric disposed in the fifth groove to increase a permittivity thereof.

* * * * *